US005527432A

United States Patent [19]

Leuthold et al.

[11] Patent Number: 5,527,432

[45] Date of Patent: Jun. 18, 1996

[54] METHOD OF DRY SEPARATING FIBERS FROM PAPER MAKING WASTE SLUDGE AND FIBER PRODUCT THEREOF

[75] Inventors: Douglas A. Leuthold, West Chester; Mark A. Leuthold, Oxford, both of Ohio

[73] Assignee: Advanced Fiber Technology, Inc., Cincinnati, Ohio

[21] Appl. No.: 189,077

[22] Filed: Jan. 28, 1994

[51] Int. Cl.[6] ..... D21F 1/66

[52] U.S. Cl. ..... 162/139; 162/DIG. 9; 209/3; 209/11; 209/44; 241/DIG. 38

[58] Field of Search ..... 162/4, 189, DIG. 9, 162/55, 56; 210/770, 771; 241/24, 19, 23, 5, DIG. 38, 19; 209/3, 11, 44

[56] References Cited

U.S. PATENT DOCUMENTS

| | | | |
|---|---|---|---|
| 2,331,455 | 10/1943 | Cowles . | |
| 2,474,314 | 6/1949 | Koehne . | |
| 3,220,546 | 11/1965 | Gardner | 162/DIG. 9 |
| 3,320,076 | 5/1967 | Sutton | 162/DIG. 9 |
| 3,698,649 | 10/1972 | Herbert . | |
| 3,741,863 | 6/1973 | Brooks | 162/4 |
| 4,052,009 | 10/1977 | Penque . | |
| 4,153,207 | 5/1979 | Cerroni . | |
| 4,154,407 | 5/1979 | Lamort . | |
| 4,216,918 | 8/1980 | Kahmann et al. . | |
| 4,219,381 | 8/1980 | Schnell . | |
| 4,225,094 | 9/1980 | Halldorson et al. . | |
| 4,272,315 | 6/1981 | Espenmiller . | |
| 4,303,019 | 12/1981 | Haataja et al. | 162/DIG. 9 |
| 4,356,060 | 10/1982 | Neckermann et al. | 162/DIG. 9 |
| 4,369,093 | 1/1983 | Lamort . | |
| 4,420,117 | 12/1983 | Peroutka et al. . | |
| 4,480,796 | 11/1984 | Paraskevas . | |
| 4,634,059 | 1/1987 | Bähr et al. . | |
| 4,810,270 | 3/1989 | Terry et al. | 162/4 |
| 4,867,383 | 9/1989 | Terry et al. | 162/4 |
| 4,872,953 | 10/1989 | Smith . | |
| 4,874,134 | 10/1989 | Weins | 241/24 |
| 4,919,340 | 4/1990 | Gerber | 241/5 |
| 4,983,258 | 1/1991 | Maxham . | |
| 5,002,633 | 3/1991 | Maxham . | |
| 5,018,459 | 5/1991 | Judd . | |
| 5,048,765 | 9/1991 | Satomi . | |
| 5,137,599 | 8/1992 | Maxham . | |
| 5,318,184 | 6/1994 | Krebs | 209/3 |

FOREIGN PATENT DOCUMENTS

| | | | |
|---|---|---|---|
| 1407703 | 9/1975 | United Kingdom | 162/DIG. 9 |

OTHER PUBLICATIONS

Casey, James P., Pulp and Paper, Chemistry and Chemical Technology, Third Edition, vol. II, Wiley—Interscience Publication (1980) p. 832.

*Primary Examiner*—Brenda A. Lamb
*Attorney, Agent, or Firm*—Harness, Dickey & Pierce

[57] ABSTRACT

Provided are methods of dry recovering useable fiber from paper making sludge. In the methods, paper making sludge is dewatered and dried. The dewatered and dried sludge is then fiberized using a dry fiberizing machine into a fibrous material consisting of fibers and other material including fiber fines, clay, filler material and the like. The fibers in the fibrous material are then separated out in a sifting process. The separated fibers are then ready for use in paper making without further processing. The fiber fines and filler material separated from the fibers is also collected and can be used as filler material in other composite material applications.

20 Claims, 1 Drawing Sheet

METHOD OF DRY SEPARATING FIBERS FROM PAPER MAKING WASTE SLUDGE AND FIBER PRODUCT THEREOF

BACKGROUND OF THE INVENTION

The present invention relates generally to paper making waste sludge processing, and more particularly, to methods for dry recovering fibers from paper making waste sludge and to the fiber products and filter fractions made according to the methods.

The manufacture of paper involves blending a pulp material (generally wood fiber) with fillers, such as clay, and other additives in water to create a stock slurry mixture. The slurry is then processed through a paper making machine to form a sheet. The water is then extracted from the sheet which is then pressed and dried thereby forming paper product. During the paper making process the water is drained. This water contains an amount of fibers and filler material. It is known to collect this material for later processing, however, the recovery is usually not complete. In other instances batches of slurry may not be used and are discarded. The discarded material and material not captured for reuse is generally transported to a waste treatment facility located near the paper making mill where the solids, i.e., the fibers and filler materials, are removed from the water and slurry and the cleaned water discharged back into the environment or communicated back to the paper making process for reuse. After such dewatering the solids are contained in a concentrated, typically 40%–60% solids, slurry or sludge. The main components of this sludge are fibers and clay filler material. This sludge is usually disposed of by burying in landfills, landspreading, or incinerating.

In the United States, the paper industry produces over 80 million tons of paper annually. It is estimated that the amount of dry waste, waste sludge with substantially all of the residual water removed, produced due to paper processing exceeds 4.6 million tons per year. Of the 4.6 million tons of dry waste, up to 1.5 million tons is fiber suitable for reuse in the industry. The remainder of the waste includes clay, ash and fiber fines (short fibers unsuitable for paper making) which may potentially be used as filler material in plastics or other material, or for other purposes. The dollar value of this recoverable fiber can range from $200 to $400 per ton or a total value of approximately $300 to $600 million dollars per year. Not included in this dollar amount are the benefits from reduced strain on the environment, i.e., less land fill space occupied by reusable materials, and less virgin wood pulp required for paper making. The benefit and value of recovering the fiber material from this waste sludge is thus readily apparent. However, to be economically feasible, the cost per ton of fiber must be competitive with the cost of producing fiber from virgin wood pulp and alternate recovered fiber sources.

In this regard, there are known "wet" processes of recovering fibers from paper making sludge. One such process, and variations of it, is the subject of U.S. Pat. Nos. 4,983,258; 5,002,633 and 5,137,599 all to Maxham. In Maxham's process, paper making sludge, either dewatered or not, is treated in a slurry with detergents and other defibering agents in a primary stage for releasing fibers from the sludge. If the sludge was previously dewatered, water is added at this primary stage to the sludge to maintain a solids concentration of approximately 20 percent. The slurry is then screened to remove clay and fiber fines and to capture the fibers. The fibers, now in a substantially dewatered suspension, are then communicated to a mixing tank where additional water is added and the fibers are further agitated. This mixture is then communicated to a hydrocyclone which imparts a centrifugal force to the slurry to remove debris having a specific gravity greater than water from the fibers. The slurry now containing substantially debris free fibers is again screened. The fibers are then carried to a bleaching tank and finally to a dewatering device. Associated with the primary processing described, is a substantial amount of secondary processing for collecting fiber fines, clay, filler materials, debris and the like as well as for processing and treating the water used during the entire process such that it may be reused or safely returned to the environment.

Wet processing of paper making sludge, such as described above, suffers a number of disadvantages. For example, the wet processes generally require a significant number of steps, and the introduction of detergents or other chemicals to facilitate separating fibers from the sludge. Also, unless the processing facility is located closely adjacent to the paper making mill, the sludge must first be dewatered for economical transportation to the processing facility, diluted for processing and then dewatered an additional time after processing. The water used in the process must be treated such that it is safe for reuse or for return to the environment. These added primary and secondary processing steps require additional energy and facilities which reduce the overall efficiency of the process and therefor raise the overall processing cost per ton of the fiber produced. Also, the processes have been found to be less efficient with sludge dewatered by particular dewatering equipment such as screw dewatering machines, and in general, wet processes require rather large processing facilities, including holding tanks and basins, pumping equipment and the like.

SUMMARY OF THE INVENTION

The present invention is directed to a dry method of recovering useable fiber from paper making sludge. In a preferred implementation of the method, paper making sludge is dewatered and dried. The dewatered and dried sludge is then fiberized using a dry fiberizing machine into a fibrous material consisting primarily of fibers and filler material consisting of fiber fines, clay, and other material. The fibers are then separated from the fibrous material by a sifting process. The separated fibers are then ready for use in paper making. The filler material separated from the fibers is also collected and can be used as filler material in plastic or other materials and/or for other purposes.

In a second embodiment of the present method, dewatered paper making sludge is dried through the application of heat and air. The air is caused to circulate around and through the sludge in a manner such that the sludge dries in a fluffed state. The fluff dried sludge may be fiberized, if necessary, and is subjected to a sifting process to separate the useable fibers from the filler material It is therefore an object of the present invention to provide methods of dry separating fiber from paper making waste sludge which is economically efficient.

It is a further object of the present invention to provide methods of dry separating fiber from paper making waste sludge which substantially reduce the processing steps and equipment for retrieving the fibers as compared to other known processes.

It is still another object of the present invention to provide methods of dry separating fiber from paper making sludge which greatly reduce secondary processing of filler material separated from the fibers.

Yet another object of the present invention is to provide fiber products from paper making waste sludge produced in accordance with the method of the present invention.

These and other objects advantages and features of the present invention will become apparent to one skilled in the art from studying the following detailed description of the preferred embodiments, the subjoined claims and attached drawings.

DETAILED DESCRIPTION OF THE INVENTION

In general, the present invention relates to methods for dry separating fibers from paper making sludge and the fiber produced by such dry separation processes. The methods produce fibers from the paper making waste sludge which may be reused in the paper making process and for other purposes. The unique processes combine the sequential dry fiberization of paper making waste sludge and separation of fibers from the resulting fibrous material to produce the reusable fiber material in a highly efficient and cost effective manner. It should be understood from the outset, however, that the teachings of the present invention are not limited to the preferred operation disclosed herein, and one of ordinary skill in the art will readily appreciate its many applications.

Figure 1:
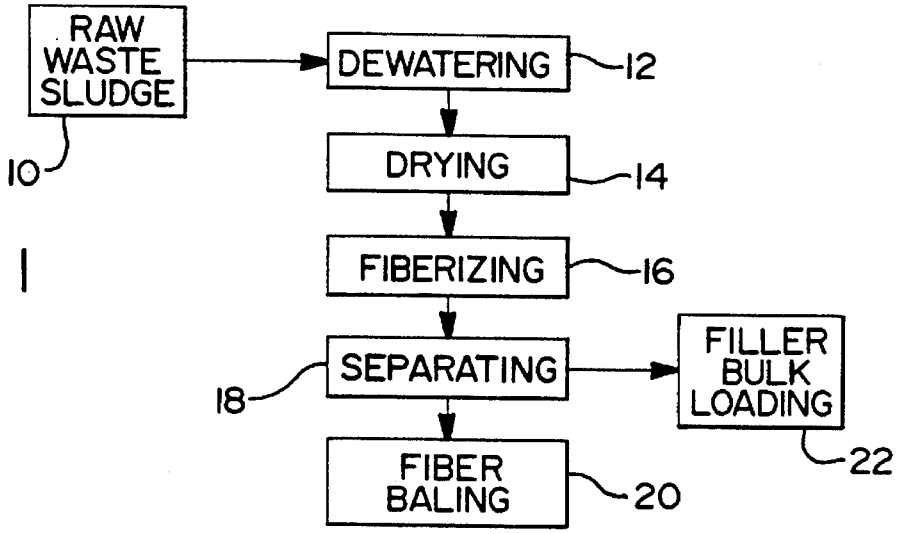
FIG. 1 is a flowchart of a dry fiber separation process according to a preferred embodiment of the present invention.

With reference to FIG. 1, at step 10, raw paper making waste sludge is collected from the paper making process and is delivered to be processed according to the present method. The raw waste sludge is first dewatered 12 by any of the well-known methods of dewatering such as screw or belt pressing, vacuum or centrifuge dewatering processes. The dewatered sludge is then dried preferably to a water content between about 5 percent and about 10 percent. Water content can be as high as 15 percent, however, higher water content tends to cause the clay and filler materials to bind to the fibers and the fibers to themselves making fiberization and separation more difficult. In contrast, with very dry sludge, i.e., 5 percent water content or less, electro-static charging advantageously assists repelling of the fibers and filler material such that fiber separation is enhanced.

In a first preferred embodiment of the present method, the sludge is dried via a suitable supplemental drying process, such as for example, externally applying heat to the dewatered sludge by a rotary kiln drier. In the present method, the temperature of the dryer will be maintained at a level in which the fibers will not be burned off. Fiber burnoff will occur when cellulose fibers reach a temperature of approximately 550 degrees F which is referred to as the point of combustion. The gas temperature in the dryer will be higher than 550 degrees, however, the fibers will not reach that temperature. This is controlled by controlling the dwell time of the fibers in the dryer.

The resulting dried sludge takes on a gravel or pellet like consistency which is easily handled and transported. In this process, the dewatering and drying are preferably completed at the paper making mill. The dried sludge is considerably easier, and more cost effective, to ship than raw sludge or dewatered concentrated sludge. As will be appreciated, the requirement that the fiber recovery facility be located closely adjacent the paper making mill to accommodate transportation of the sludge is eliminated. In addition, it is possible to provide centrally located facilities to regionally service paper making mills in a more economical fashion. The pellet like dried sludge is then further processed, as will be described, to separate the useable fiber from the filler material.

In a second preferred embodiment of the method, the dewatered sludge is dried through the application of heat and air. Fans are positioned such that heated air is caused to circulate around and through it such as in fluidized bed drying. In fluidized bed drying, hot air passes up through the material being dried. As the material dries, it becomes lighter and less dense. The upward air flow and the weight of the dried fiber eventually reach equilibrium, and the material lifts off of the bed. This action tends to fluff the fiber more than in the rotary kiln drying process. The fluidized bed dried sludge can be directly used in the paper making process for packaging paperboard or newspaper products, but it is preferably processed further and in accordance with the teachings of the present method to further separate the fibers from the filler material for use in finer quality paper.

Figure 2:
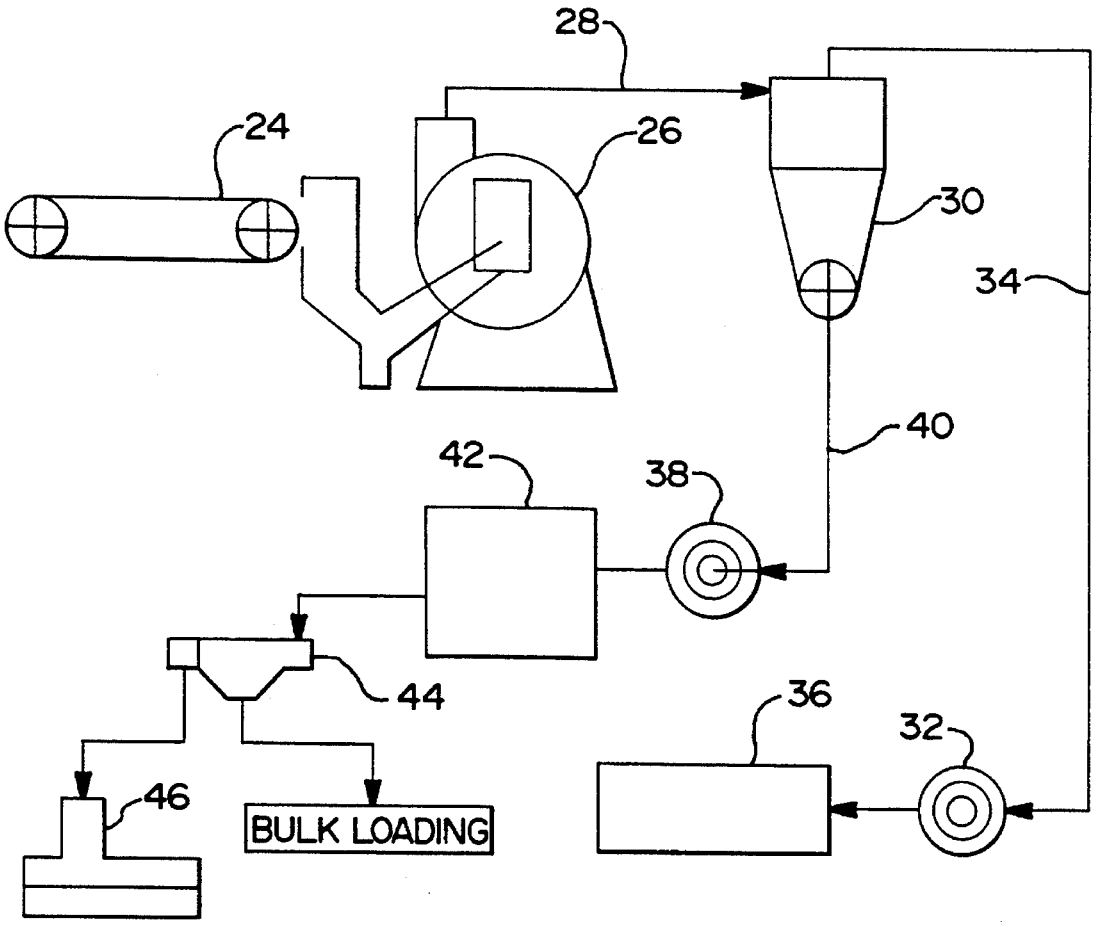
FIG. 2 is a schematic diagram illustrating the processing features of the dry fiber separation process in accordance with a preferred embodiment of the present invention.

With continued reference to FIG. 1 and with further reference to FIG. 2, at step 16, the pelletized dried paper making sludge is fiberized. In the preferred embodiment, the pellet form dried paper making sludge is communicated to a dry fiberizer 26 by a conveyor 24. Dry fiberizer 26 is preferably one of the types disclosed and described in U.S. Pat. Nos. 4,919,340 or 5,188,298, the disclosures of which are hereby expressly incorporated by reference. It should be readily understood that other types of dry fiberizing or comminuting machines, such as hammer mills and the like, may be used in performing the fiberizing step in practice of the present method without departing from its fair scope. In general, however, hammer mills and other types of mechanical comminuting machines are less preferred to the fiberizing machines disclosed in the aforementioned U.S. Patents. This is because the mechanical action of these machines in separating fibers may have a tendency to damage and break the fibers hence increasing the amount of fiber fines and reducing the yield of useable fiber recovered from the dried sludge.

In the preferred embodiment, dry fiberizer 26 converts the pelletized dried paper making sludge material from its gravel like consistency to a low density dry fibrous product. As more completely described in the aforementioned U.S. Patents, the fiberizer 26 entrains the pelletized sludge in a high velocity air stream. The air stream, with dried sludge entrained therein, is caused to pass through a screen at high velocities. The action of passing the dried sludge material through the screen at high velocity causes the desired fiberization of the material. The fiberizer 26 includes rakers which rotate at high velocity within the machine for preventing blinding of the screen. The fibers passing through the screen openings are then carried in the airstream from the fiberizer 26. In the preferred embodiment, the openings in the screen are approximately 3/64 inch in diameter.

The fluffed dried sludge from the second preferred drying method is only processed through dry fiberizer 26 if further fiber separation is required. The fluffed dried sludge advantageously allows for the use of larger diameter holes in the fiberizer screen thus allowing for greater flowrates and fiberizer throughput. In the preferred embodiment, hole sizes of about 1/16 inch may be used to fiberize the fluffed dried sludge.

The fibrous material discharged from fiberizer 26 contains useable fibers and filler material which consists essentially of fiber fines and clay. This material is communicated in the air stream from fiberizer 26 via a duct assembly 28 to an air/fiber separator 30 which separates the fibrous material from the air stream. The separated air is further communicated, with the assistance of fan 32 via duct 34 to a filter system 36 which screens fine dirt and particles from the air and discharges the filtered air to the environment.

The fibrous material, either from the dry fiberizer 26 or from the fluff drying process is communicated, by fan 38 and duct assembly 40 to a surge bin 42. Surge bin 42 is provided to accumulate fibrous material to ensure a uniform rate of delivery of the fibrous material to the separator 44.

At step 18, the fibrous material is separated into fibers for use in the paper making process and filler material by separator 44. Separator 44 is preferably a centrifugal sifter, suitable ones of which are Model No. K-1350 manufactured by Kemutec of Philadelphia, Pa. or Model No. YOB manufactured by Kason Corporation of Linden, N.J. The sifter may be operated with a range of screen sizes from about 50 mesh to about 200 mesh. Screen sizes of 80 and 100 mesh have been found to provide good fiber yield and filler separation with acceptable feed rates and throughput. The screen size, however, should be selected based upon the requirements for the final product. That is, if the final product into which the recovered fibers are to be incorporated requires less filler material, then larger mesh openings will be used to allow the larger filler particles to be sifted from the fibers. It should also be understood that several sifters may be used in series, with progressively finer screen mesh to provide fiber/filler separated product at various intermediate stages.

During the sifting process, the filler material, i.e., fiber fines and clay, pass through the sifting screen and are collected in bulk, step 22. The longer fibers pass over the screen and are discharged from the end of the sifter. These fibers are collected at step 20 in a baling machine 46 and are baled and made ready for shipping. It has been found desirable to make several modifications to the aforementioned preferred centrifugal sifters to facilitate processing of the fiber. First, the end plate of the sifter should be modified such that the volume of the discharge opening is increased. This is because the fibers are very fluffy with a low bulk density at this stage of processing and tend to hang up in the sifter if the discharge opening is not made larger than the standard opening. Also, the angle of the discharge chute under the screen is preferably increased such that the filler material passing through the screen is carried away more quickly.

The recovered fiber is relatively debris and filler free, however, it does still contain a small amount of clay. This, however, is not a hinderance to the paper making process since clay and other chemicals are normally added to the fibers in the final paper product. In making paper from the recovered fibers, a portion of virgin fiber is added to the recovered fiber along with additional clay and other minerals and chemicals to attain a desired finished material.

Freeness is a standard measure of how well the fibers retain water. The higher a freeness number, the faster water drains from the fibers. For example, virgin 50 percent hardwood/50 percent softwood pulp fiber generally has a freeness of 600+. The fiber recovered according to the present methods generally has a freeness of a similar level. The desired freeness during paper making is typically a function of the fiber properties.

As will be appreciated from the foregoing, the method of the present invention substantially reduces the number of processing steps required in known fiber separating methods. In addition, the secondary processing of water used in the wet processing is eliminated providing a further economic advantage to the dry fiber recovery process.

It should be further appreciated that the method of the present invention was described in exemplary fashion for dry processing paper making waste sludge into useable fiber. It should be readily apparent to one of ordinary skill in the art that the method may be further practiced for the processing, recovery, and classification by separation of fibers from other dry cellulosic materials such as office paper, news paper, etc., and the like.

While a specific embodiment has been shown and described in detail to illustrate the principles of the present invention, it will be understood that the invention may be embodied otherwise without departing from such principles. For example, one skilled in the art will readily recognize from such discussion and from the accompanying drawings and claims that various changes, modifications and variations can be made therein without departing from the spirit and scope of the invention as described in the following claims.

What is claimed is:

1. A method of processing dried paper making waste sludge to recover useable fibers comprising the steps of:

(a) fiberizing the dried paper making waste sludge to form a fibrous material comprising the fibers and a filler material;

(b) separating the fibrous material into the fibers and the filler material; and (c) collecting the fibers.

2. The method of claim 1 wherein the step of fiberizing comprises entraining the dried paper waste making sludge in an air stream at high velocity and passing the air stream with said paper making waste sludge entrained therein through a screen.

3. The method of claim 2 further comprising, between the steps of fiberizing and separating the fibrous material, the step of separating the fibrous material from the air stream.

4. The method of claim 3 further comprising, after the step of separating the fibrous material from the air stream, the steps of filtering the air stream and discharging the air stream to the environment.

5. The method of claim 3 further comprising, between the step of separating the fibrous material from the air stream and separating the fibrous material into the fibers and the filler material, the step of accumulating the fibrous material in a surge bin.

6. The method of claim 1 wherein the step of fiberizing comprises mechanically comminuting the dried paper making waste sludge.

7. The method of claim 1 wherein the step of separating comprises screening the fibrous material.

8. The method of claim 7 wherein the step of separating further comprises sifting the fibrous material through a plurality of progressively finer mesh screens.

9. The method of claim 1 wherein the step of collecting comprises baling the fibers.

10. A method of recovering useable fibers from dried paper making sludge comprising the steps of:

(a) fiberizing the dried paper making sludge into a fibrous material comprising the fibers and a filler material by entraining the dried paper making sludge in an air stream at high velocity and passing the air stream with said paper making sludge entrained therein through a screen;

(b) centrifugally sifting the fibrous material to separately recover the fibers and the filler material; and (c) collecting the fibers.

11. The method of claim 10 wherein the step of centrifugally sifting comprises the step of sequentially sifting the fibrous material through progressively finer mesh screens.

12. The method of claim 10 further comprising, between the steps of fiberizing and centrifugally sifting, the step of separating the fibrous material from the air stream.

13. The method of claim 12 further comprising, between the steps of separating and centrifugally sifting, the step of accumulating the fibrous material in a surge bin.

14. The method of claim 13 further comprising the step of baling the fibers.

15. A method of recovering usable fibers from paper making sludge comprising the steps of:

(a) drying the paper making sludge on a fluidized drying bed by forcing heated air through and around the paper making sludge to form a fibrous material comprising the fibers and a filler material;

(b) separating the fibrous material into the fibers and the filler material; and (c) collecting the fibers.

16. The method of claim 15 further comprising the step of fiberizing the fibrous material to recover additional fibers therefrom.

17. The method of claim 15 wherein the step of drying comprises forcing heated air upwardly through the fluidized drying bed such that the upward flow of air causes the fibers to be lifted from the fluidized bed when the fibers are substantially dry.

18. The method of claim 17 wherein the step of drying further comprises dewatering the paper making sludge before drying the paper making sludge on the fluidized drying bed.

19. The method of claim 15 wherein the step of separating comprises sifting the fibrous material.

20. The method of claim 19 wherein the step of separating further comprises sifting the fibrous material through a plurality of progressively finer mesh screens.

* * * * *